United States Patent [19]

Spiroff

[11] Patent Number: 4,655,420

[45] Date of Patent: Apr. 7, 1987

[54] LOW HEIGHT FIN CONTROL ACTUATOR

[75] Inventor: Carl M. Spiroff, Granite City, Ill.

[73] Assignee: The United States of America as represented by the Secretary of the Air Force, Washington, D.C.

[21] Appl. No.: 502,818

[22] Filed: Jun. 9, 1983

[51] Int. Cl.[4] ..... F42B 15/027

[52] U.S. Cl. ..... 244/3.24; 384/491; 384/510

[58] Field of Search ..... 384/542, 537, 510, 490, 384/547; 244/3.24–3.3, 3.21

[56] References Cited

U.S. PATENT DOCUMENTS

| | | | |
|---|---|---|---|
| 1,337,882 | 4/1920 | Bott | 384/510 |
| 1,870,860 | 8/1932 | Mayer | 384/542 |
| 3,093,075 | 6/1963 | Garrett et al. | 102/50 |
| 3,102,437 | 9/1963 | Geyer | 244/3.21 |
| 3,112,902 | 12/1963 | Kongelbeck | 244/3.21 |
| 3,273,500 | 9/1966 | Kongelbeck | 102/50 |
| 3,309,157 | 3/1967 | Schlueter | 384/615 |
| 3,515,360 | 6/1970 | Alexander | 244/3.28 |
| 3,711,040 | 1/1973 | Garver | 244/3.21 |
| 3,770,226 | 11/1973 | Kranz | 244/3.21 |
| 3,843,075 | 10/1974 | Weber et al. | 244/3.21 |

*Primary Examiner*—Harold J. Tudor

*Attorney, Agent, or Firm*—Bobby D. Scearce; Donald J. Singer; John R. Flanagan

[57] ABSTRACT

A missile fin control actuator includes a housing having a hollow cavity within which is mounted a single bearing. On the inner race of the bearing, a lower cap attaches the base of a fin mounting shaft or integral fin for rotation with the inner race. The outer race of the bearing is retained in a fixed position in the housing by an upper cap. A crankarm attached to the lower cap may be actuated to rotate the lower cap and the inner race and mounting shaft (or integral fin) therewith.

3 Claims, 10 Drawing Figures

LOW HEIGHT FIN CONTROL ACTUATOR

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The present invention broadly relates to missile fin control and, more particularly, is concerned with an actuator of minimum height using a single large diameter bearing having both radial and thrust capacity to support a fin shaft and thereby permitting better aerodynamic shaping of the missile body.

2. Description of the Prior Art

In conventional practice, missile control fins are commonly positioned by actuators mounted completely within the missile aft body. A fin is usually attached to an actuator by means of a circular shaft through which rotational torques and speeds, required for missile control, are achieved. In general, a high degree of torsional and bending stiffness is required. Actuators may be electrically, pneumatically, or hydraulically powered.

One conventional actuator shown in a group of four thereof in FIG. 1 and in dashed line form in FIG. 3 has two bearings spaced apart, one above the other, at distance "d" along the fin shaft to allow the shaft to rotate freely and react loads $R_1$ and $R_2$ imposed by the fin shaft due to aerodynamic loads on the fin. In conventional actuators. distance d is a minimum bearing spacing compatible with maximum allowable bearing loads. These bearing loads are transferred to the actuator housing and finally reacted to the missile body to accomplish the desired missile attitude.

One shortcoming of this conventional actuator design is that it can result in excessive actuator height, designated as "h" in FIG. 1, extending beyond the missile. Thus, a problem is presented in that additional aerodynamic fairings are required to minimize the additional drag which is otherwise produced due to the excessive actuator height. A second shortcoming is that root torsional and bending stiffness to meet flutter requirements is limited by the diameter of the actuator fin shaft. Larger diameter fin shafts may be used to increase torsional and bending stiffness but result in more exposed areas, again resulting in greater drag penalty.

As a consequence, a need exists for improvement in actuator construction to reduce its height or extension beyond the missile body and thereby eliminate costly corrective measures required to be taken as a result thereof. Such need is met by a fin extension of rectangular cross-section, with wedged or rounded front and back faces to reduce drag, and terminating as a large diameter support of the inner race of a large diameter bearing which is capable of simultaneously reacting radial and reversing thrust loads.

SUMMARY OF THE INVENTION

The present invention provides a missile fin control actuator designed to satisfy the aforementioned needs. The unique features of the actuator are its employment of a single, large diameter ball bearing and a split assembly of the rotating shaft. The use of a single bearing having both radial and thrust capacity, instead of the two separate bearings of high radial capacity as used heretofore, allows reaction of the fin side load as a bearing radial load having a magnitude below the radial load capacity of the bearing, and the moment due to the side load is reacted by the bearing thrust capability. Such bearings are referred to as turntable or slewing bearings. The use of the split assembly allows rigid clamping of the inner race of the bearing, at the top and bottom sides thereof and about its circumference, to the assembly forming the fin shaft or fin extension. These two features provide an actuator having a lower height so as to provide less protuberance beyond the missile body and improved capability in minimizing bearing thrust loads for a given fin side load. The split assembly also provides for an integral fin and maximum fin root which results in a high degree of torsional and bending stiffness (as compared to the limited properties of a circular shaft) and without comprising aerodynamic drag. As seen in comparing FIG. 2 with FIG. 1, the low height actuator of the present invention permits better aerodynamic shaping of the missile aft body with a resultant reduction in drag. The single large diameter bearing reacts fin load F with an opposite radial load R and reacts the resulting moment as a distributed thrust load T above and on one half of the bearing race, and another distributed thrust load T below and on the other half of the bearing race. It also minimizes interference with adjacent portions of the missile and provides a more efficient use of available volume. In the case of a ram-jet missile, little or no depression into the region of the ram throat would be required, thus permitting a circular cross-section throat area (FIG. 2) in the combustor. If there are limiting external packaging restraints around the missile, the conventional height actuator may require protrusion into the ram throat which results in a non-round or rectangular shaped throat area (FIG. 1). Although functional, the combustor for the ram-jet in the latter case would be considerably more complex to manufacture.

Accordingly, the present invention is directed to a missile fin control actuator, which comprises the combination of: (a) an actuator housing; (b) a single bearing including an outer race, an inner race, and means located therebetween and mounting the races for rotation relative to one another; (c) first means attached to the housing and retaining the outer race in a fixed position therein such that the inner race is rotatable relative to the fixed outer race; (d) fin mounting means; (e) second means attached to the fin mounting means and mounting the same on the inner race for rotation therewith; and (f) means connected to the second attached means and being actuatable for rotating the same and thereby the inner race and the fin mounting means therewith for controlling the angular position of the fin mounting means. The first attached means comprises an annular upper cap attached to the housing and clamping the outer race of the bearing between the upper cap and housing. The second attached means comprises a lower cap attached to the fin mounting means and clamping the inner race between the lower cap and fin mounting means.

DETAILED DESCRIPTION OF THE INVENTION

Figure 1:
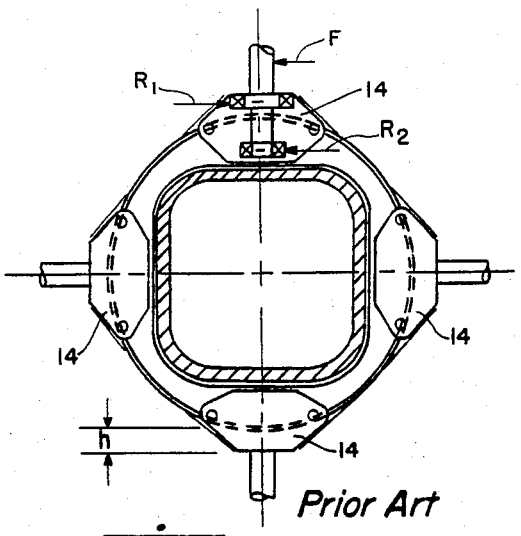
FIG. 1 is a schematic cross-sectional representation of a missile aft body with a group of four prior art actuators arranged thereon.
Figure 2:
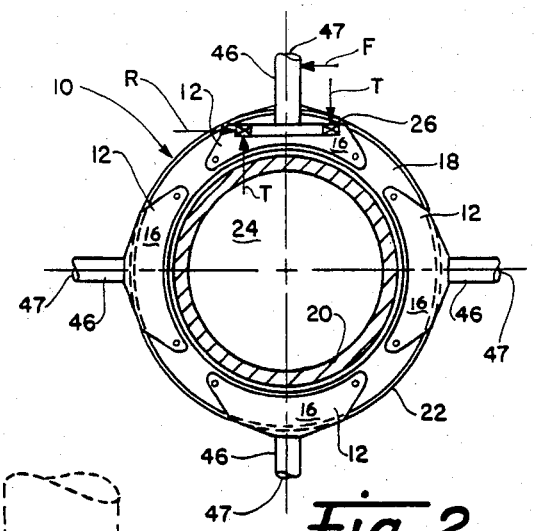
FIG. 2 is a schematic cross-sectional representation of a missile aft body with a group of four actuators arranged thereon, each being constructed in accordance with the principles of the present invention.
Figure 3:
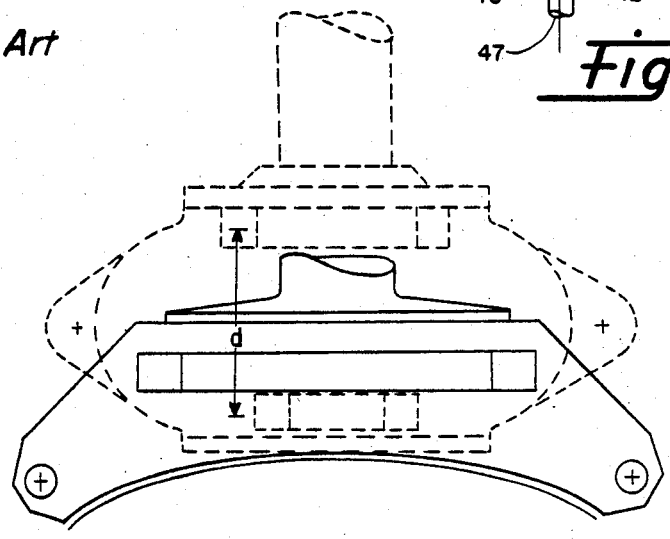
FIG. 3 is an end elevational view superimposing the profiles of the prior art actuator (in dashed outline) and the actuator of the present invention (in solid outline) on one another for purposes of illustrating the difference between the respective heights of the two actuators.

Referring now to the drawings, and more particularly to FIG. 2, there is shown a schematic representation of a missile aft body 10 with a group of four missile fin control actuators 12 arranged therein, each actuator being constructed in accordance with the principles of the present invention. When compared to the arrangement of the prior art actuators 14 shown in FIG. 1, it is readily apparent that the arrangement of the actuators 12 of the present invention shown in FIG. 2, by having a low height (refer to height comparison shown in FIG. 3) and a generally arcuate-shaped housing 16, allows for a more efficient use of the available space 18 between the combustor 20 and outer skin 22 of the missile aft body 10. This space 18, having a generally ring-shaped configuration, permits better aerodynamic shaping of the missile aft body 10 and a more optimum shape for the region of the throat area 24 of the combustor 20.

As depicted in greater detail in FIGS. 4 and 6–8, missile fin control actuator 12 includes the actuator housing 16 and a single, large diameter bearing 26 located in the housing. The bearing 26 is formed of an outer race 28, an inner race 30, and a plurality of balls 32 mounting the races for rotation relative to one another.

Also, the actuator 12 includes first means in the form of an upper annular cap 34 attached by bolts 36 to a rim 38 of the actuator housing 16 which surrounds a hollow cylindrical cavity 40 defined therein. The housing 16 has an annular ledge 42 which is spaced below the rim 38 and protrudes into the cavity 40 for seating thereon the outer race 28 of the bearing 26. Thus, when the upper cap 34 is attached to the housing rim 38 an inner annular edge portion of the cap overlies the outer race 28 of the bearing 26 and clamps the same between itself and the ledge 42 of the housing 16. In such manner, the outer race 28 is retained in a fixed position in the housing 16 such that the inner race 30 is rotatable relative to the fixed outer race 28.

Further, the actuator 12 includes the fixed part of a folding fin 47 (FIGS. 7 & 8) and second means for attaching it to the inner race 30 of the bearing 26. The fixed fin 47 is a part of the fin root extension 46 of fin mounting means in the form of a disk-shaped base 44. The fixed missile fin is thus oriented to extend along the outer skin 22 of the missile aft body 10. The base 44 has an upper circular portion 48 of a diameter greater than the inside diameter of the inner race 30 (and approximately the same as the outside diameter thereof) and a lower circular portion 50 of a diameter less than the inside diameter of the inner race 30. The annular underside surface on the upper portion 46 of the base 44 thus forms a shoulder 52 which overlies and rests on the inner race 30 of the bearing 26 with the lower portion 50 inserted into the inner race from the top thereof. Second means for attaching the base 44 to the inner race 30 takes the form of a lower disk-shaped cap 54. The cap has a lower circular part 56 of a diameter greater than the outside diameter of the inner race 30 and an upper circular part 58 of a diameter less than the inside diameter of the inner race 30. The annular upperside surface on the lower part 56 of the cap 54 thus forms a ledge 60 which underlies and seats the inner race 30 of the bearing 26 with the upper part 58 of the cap 54 inserted into the inner race from the bottom thereof. Therefore, when the lower cap 54 is attached to the base 44 by bolts 62, the inner race 30 of the bearing 26 is clamped between the shoulder 52 of the base 44 and the ledge 60 of the lower cap 54. In such manner, the fin mounting means (i.e. base 44 and shaft 46) along with the lower cap 54 are mounted to the inner race 30 for rotation therewith.

Finally, the actuator 12 includes means connected to the lower cap 54 which is actuatable for rotating it and the inner race 30 and therewith the base 44 and root 46 for controlling the angular position of the fin root 46. Such means may take the form of a crank arm 64 attached to the lower part 56 of the lower cap 54 by bolts 66. Loading holes 68 (only one being seen in FIG. 4) are provided in the housing 16 for gaining access to the opposite ends of the crank arm 64 for inserting bolts 66 to attach the crank arm to the cap 54. A plug 70 is used to close the holes 68 when access is not required. Seals 67 and 69 are environmental seals.

Figure 5:
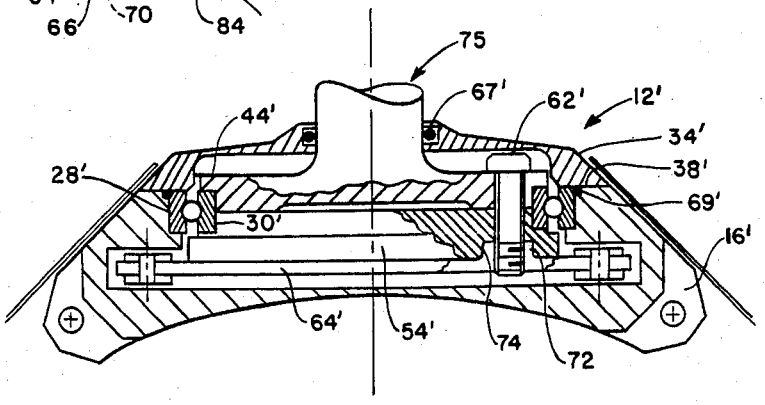
FIG. 5 is an end elevational view, partly in section, of an alternate preferred embodiment of the actuator of the present invention, showing a circular shaft extension of the actuator.
Figure 10:
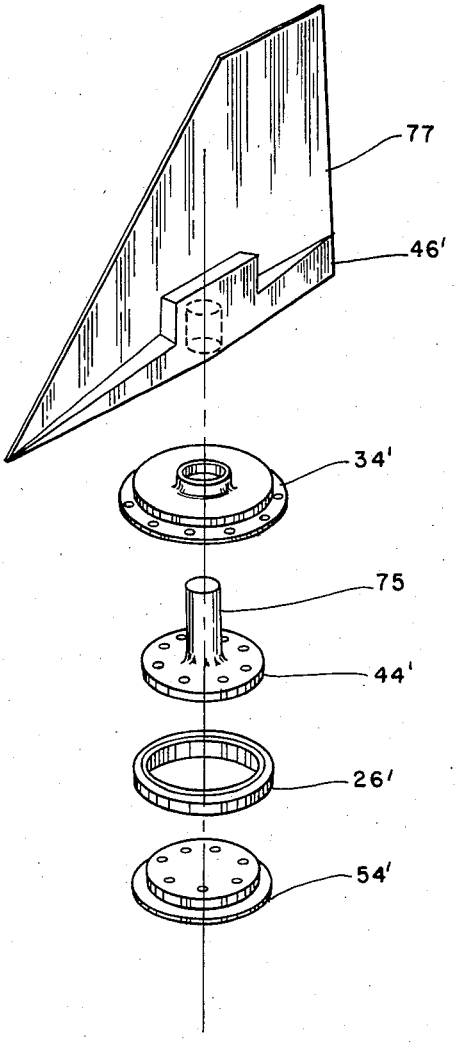
FIG. 10 is an exploded perspective view of the actuator of FIG. 5 with the fin being shown but without the actuator housing.

FIG. 5 shows an alternative embodiment of the actuator 12' wherein bolts 66, holes 68 and plugs 70 are eliminated by use of upstanding bosses 72 (only one being seen) formed in the crank arm 64' which insert into holes 74 in the lower cap 54' and are attached thereto by the same bolts 62' which attach the base 44' and lower cap 54' together so as to clamp the inner race 30' therebetween. Further, actuator 12' includes a fin mounting means in the form of a round central shaft 75 which is integral with disk 44' and extends outwardly therefrom to support a missile fin 77 (FIG. 10). This type of fin is more common but may lack torsional and bending stiffness requirements. Seals 67' and 69' are environmental seals.

Figure 6:
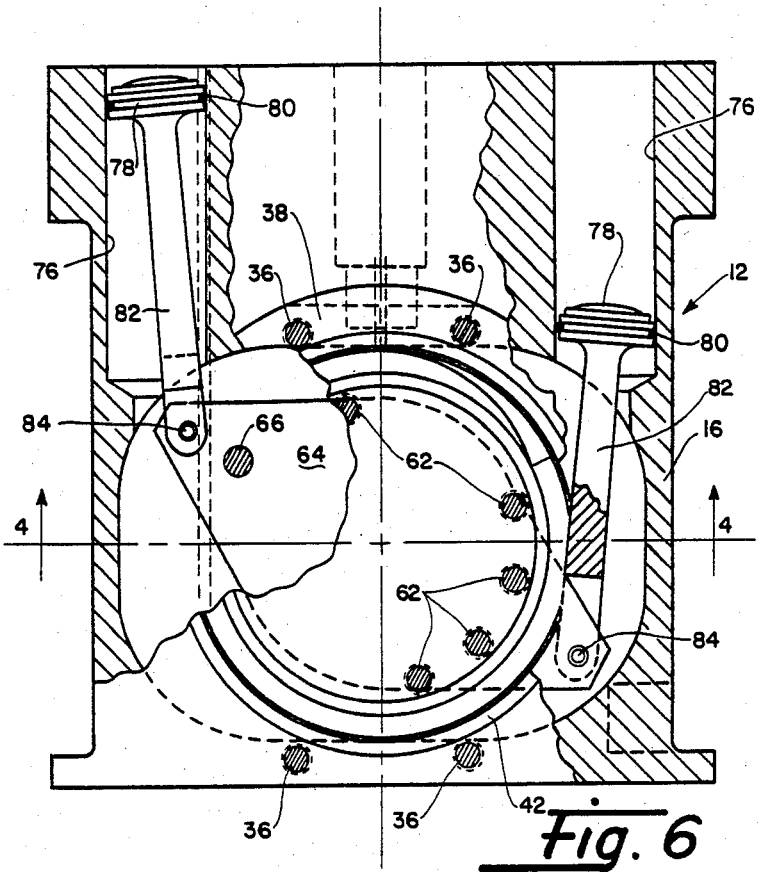
FIG. 6 is a top plan view of the actuator taken along line 6—6 in FIG. 4 with portions broken away and with the bearing omitted.
Figure 7:
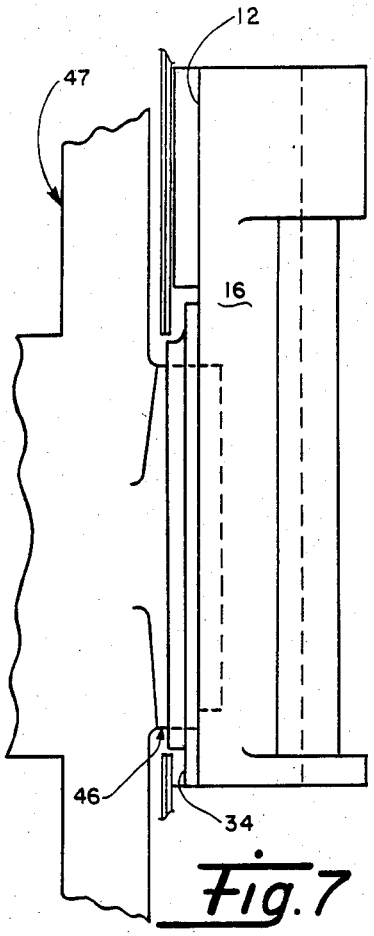
FIG. 7 is a side elevational view of the actuator of FIG. 6, showing an integral fin root and a portion of the fin.
Figure 8:
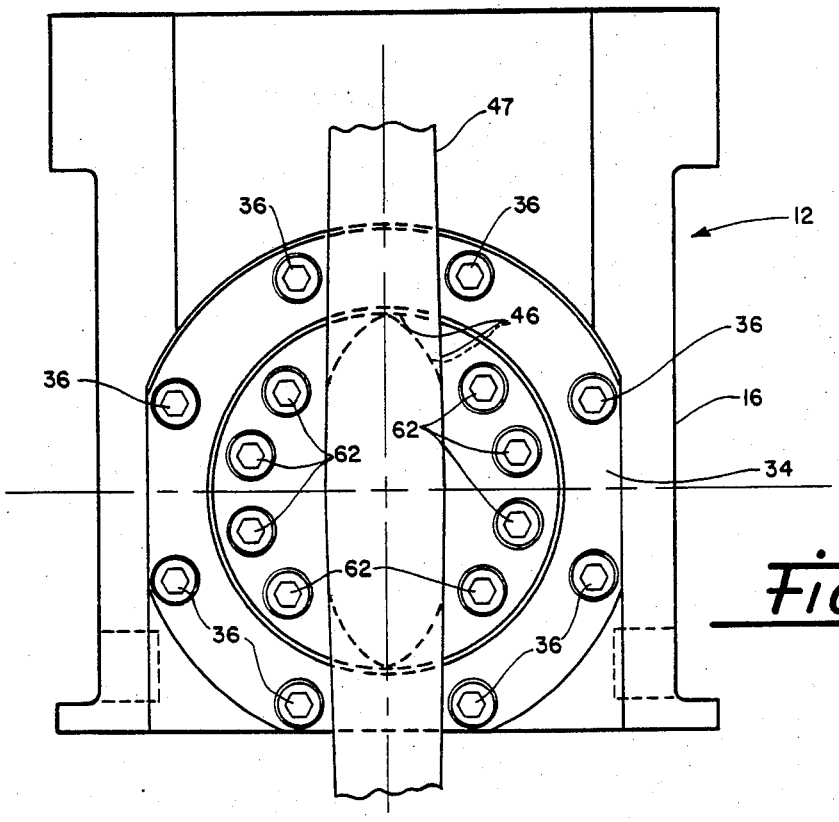
FIG. 8 is a top plan view of the actuator similar to that of FIG. 6 except now showing the completed actuator with a portion of a fin mounted thereon.

As seen in FIG. 6, two hydraulic cylinders 76 are formed in the actuator housing 16. Each has a piston 78 and seal 80 slidably mounted therein on an end of a rod 82 which is pivotally connected at its opposite end to one end of the crank arm 64 by a pin 84. The crank arm 64 thereby receives thrust from piston rod 82 through pin 84 with the piston 78 and seal 80 operating in a conventional manner within each cylinder 76 by application of hydraulic fluid pressure. Although the actuator construction is illustrated using hydraulic power for rotating the missile fin, electrical or pneumatic means could be used for such purpose.

Figure 4:
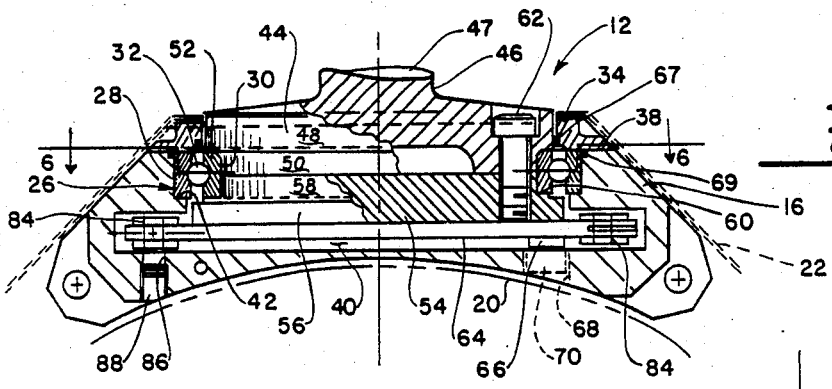
FIG. 4 is an end elevational view, partly in section, of one preferred embodiment of the actuator of the present invention, as seen along line 4—4 of FIG. 6, with an integral fin and fin root as an extension of the actuator.

To assemble the actuator 12, the crank arm 64 is placed into the actuator cavity 40 and secured to the ends of the piston rods by insertion of pins 84 through pin loading holes 86 (only one being shown in FIG. 4). The hole 86 is then closed by plug 88. Upper cap 34 is placed on the outer bearing race 28 and then the upper race 30 is assembled to the lower cap 54 and the base 44 of the fin using bolts 62. Then the assembly is lowered into the housing cavity 40 so as to seat the outer race 28 on the ledge 42. Upper cap 34 is then attached by bolts 36 to the housing rim 38. Finally, the crank arm 64 is attached to the lower cap 54 using bolts 66 and access holes 68. It can be seen that the upper cap 34 cannot be removed now due to the integral fin root 46 above it. However, when assembling actuator 12 (FIG. 5), upper cap 34' is assembled over round fin shaft 75 and then attached to housing rim 38'. Also when assembling actuator 12', parts 44', 28', and 64' are all assembled by bolts 62' simultaneously.

Figure 9:
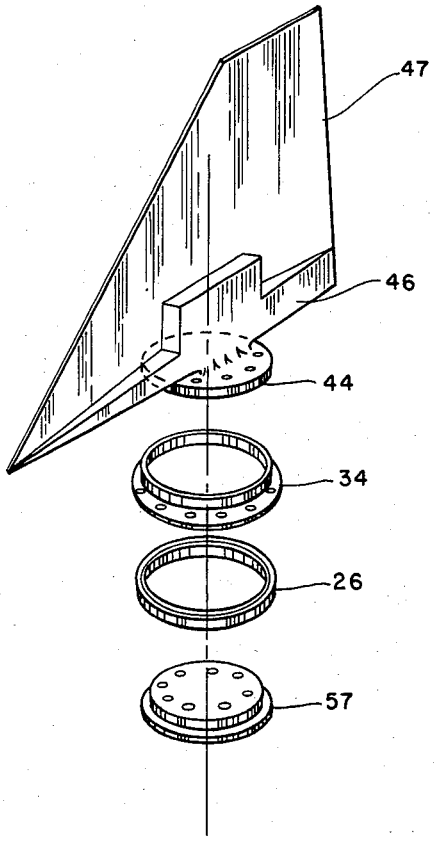
FIG. 9 is an exploded perspective view of the actuator of FIG. 4 with the fin being shown but without the actuator housing.

FIGS. 9 and 10 depicted the principal parts of the actuators 12 and 12' of FIGS. 4 and 5, respectively without the housings 16 and 16'. It can be readily seen that both embodiments include upper and lower caps 34, 54 and 34', 54', bearings 26, 26' and disk-shaped bases 44, 44'. The basic difference between the two embodiments is directed to the particular fin and fin mounting structure. In the FIG. 9 embodiment, the fin root 46 is integral with the base 44, while in the FIG. 10 embodiment, shaft 75 integral with base 44' in turn mounts fin root 46'. In the case of the FIG. 9 embodiment, maximum stiffness is achieved between the fin and bearing due to the one-piece construction of the fin root 46 and base 44. In the FIG. 10 embodiment, stiffness is limited to the structural properties of shaft 75 and the quality of its attachment to fin root 46'. Fins 47 and 77 are the erectable extentions to 46 and 46', thus defining the complete fin.

It is thought that the missile fin control actuator of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. A low height control actuator for a missile fin control surface, comprising:

(a) an actuator housing defining a hollow, substantially cylindrically shaped cavity;

(b) single bearing means supported within said cavity for reacting both radial loads and reversing thrust loads simultaneously resulting from an external mechanical force applied to said missile fin control surface, said bearing means consisting solely of concentric circular outer and inner races defining a pair of confronting annular race surfaces and a single row of a plurality of balls located between said race surfaces and mounting said races for rotation relative to one another;

(c) an annular cap member attached to said housing and defining an opening in said housing to said cavity, said annular cap member retaining said outer race in a fixed position relative to said housing within said cavity whereby said inner race is rotatable relative to said outer race and said housing;

(d) fin mounting means including a disk-shaped base and an integral fin root and fin connected thereto and extending outwardly therefrom for supporting said fin control surface for rotation relative to said housing;

(e) said disk-shaped base disposed within said opening defined by said annular cap member and attached to said inner race for rotation therewith; and (f) actuating means operatively connected to said disk-shaped base for selectively rotating the same and said inner race and said fin root for controlling the angular position of said fin control surface.

2. The low height control actuator as recited in claim 1, wherein said actuating means includes a lower disk-shaped cap attached to said disk-shaped base and clamping said inner race between said lower disk-shaped cap and said disk-shaped base.

3. A control actuator for a missile fin control surface, comprising:

(a) a hollow actuator housing having an annular ledge therein;

(b) single bearing means supported on said annular ledge within said actuator housing for reacting both radial loads and reversing thrust loads simultaneously resulting from an external mechanical force applied to said missile fin control surface, said bearing means consisting solely of concentric circular outer and inner races defining a pair of confronting annular race surfaces and a single row of a plurality of balls located between said race surfaces and mounting said races for rotation relative to one another;

(c) an upper annular cap attached to said housing and defining an opening therein above said bearing and clamping only said outer race in a fixed position relative to said housing between said cap and said ledge within said actuator housing whereby said inner race is rotatable relative to said outer race and said housing;

(d) fin mounting means including a disk-shaped base and integral fin root and fin connected thereto and extending outwardly therefrom for supporting said fin control surface for rotation relative to said housing, said disk-shaped base disposed within said opening defined by said annular cap member and attached to said inner race for rotation therewith;

(e) a lower cap having an annular ledge which underlies said inner race, said lower cap being attached to said disk-shaped base and clamping said inner race between said disk-shaped base and said ledge for rotation therewith; and (f) a crank arm connected to the underside of said lower cap and being actuatable for rotating the same and said inner race and disk-shaped base for controlling the angular position of said fin control surface.

* * * * *